166-319 SR

7/1/86 OR 4,597,445

United States Patent [19]

Knox

[11] Patent Number: 4,597,445

[45] Date of Patent: Jul. 1, 1986

[54] WELL SUBSURFACE SAFETY VALVE

[75] Inventor: Richard H. Knox, Spring, Tex.

[73] Assignee: Camco, Incorporated, Houston, Tex.

[21] Appl. No.: 702,980

[22] Filed: Feb. 19, 1985

[51] Int. Cl.[4] ..... E21B 34/10

[52] U.S. Cl. ..... 166/319; 166/375

[58] Field of Search ..... 166/319, 316, 332, 334, 166/324, 325, 321, 375; 277/212 F, 225, 102

[56] References Cited

U.S. PATENT DOCUMENTS

| | | | |
|---|---|---|---|
| 4,160,484 | 7/1979 | Watkins | 166/332 X |
| 4,161,219 | 7/1979 | Pringle | 166/324 |
| 4,427,071 | 1/1984 | Carmody | 166/332 |
| 4,452,310 | 6/1984 | Pringle et al. | 166/319 |

FOREIGN PATENT DOCUMENTS

| | | | |
|---|---|---|---|
| 0676798 | 7/1979 | U.S.S.R. | 166/319 |

*Primary Examiner*—Stephen J. Novosad
*Assistant Examiner*—David J. Bagnell
*Attorney, Agent, or Firm*—Fulbright & Jaworski

[57] ABSTRACT

A hydraulically actuated well subsurface safety valve having a tubular member telescopically movable in the housing for controlling the movement of a flapper valve closure member in which a seal is telescopically movable in the housing and positioned in the path of travel of the lower end of the tubular member for sealing against the lower end of the tubular member. A spring urges the seal towards the tubular member for sealing when the valve is in the open position for limiting damaging fluid flow across the valve closure member.

2 Claims, 4 Drawing Figures

WELL SUBSURFACE SAFETY VALVE

BACKGROUND OF THE INVENTION

It is well known, as shown in U.S. Pat. No. 4,161,219, to utilize a piston actuated well safety valve in which a tubular member is telescopically movable in a valve housing to control the opening and closing of a flapper valve member in which the back of the flapper valve element is exposed to well fluids for aiding the valve member to close. However, when the valve is in the open position, well fluid flows around the valve element and the lower end of the tubular member causing erosion, sand buildup and decreases the service life of the valve.

The present invention is directed to providing a seal in the safety valve housing positioned to seal against the lower end of the tubular member when the tubular member is in the open position. The seal limits fluid flow about the flapper valve member thereby decreasing erosion and sand buildup without subjecting the tubular member to undue compressive forces.

SUMMARY

The present invention is directed to a well subsurface safety valve having a housing with a bore and a flapper valve closure member in the bore moving between open and closed positions. A tubular member is telescopically movable in the housing for controlling the movement of the valve closure member. Hydraulic piston means acts on the tubular member for moving the member downwardly for opening the valve closure member, and biasing means are connected to the tubular member for moving the tubular member upwardly for allowing the valve closure member to close. Movable seal means are telescopically movable in the housing and positioned in the path of travel of the lower end of the tubular member for sealing against the lower end of the tubular member. Spring means between the housing and the movable seal means urges the seal means towards the tubular member for sealing against the lower end of the tubular member when the valve is in the open position thereby limiting fluid flow which causes sand buildup around the valve member, creates erosion on the valve member, and thereby decreases service life of the safety valve. However, the seal does not subject the tubular member to undesirable compressive forces.

A still further object of the present invention is the provision of stop means between the housing and the seal means limiting the extent of travel of seal means in the upper and lower direction.

Still a further object of the present invention is wherein the seal means is a resilient and nonmetallic seal such as an elastomer or plastic.

Yet a still further object of the present invention is wherein the housing includes a recess spaced from the bore and the seal means includes a portion telescopically movable in the recess and the spring means is positioned in the recess thereby protecting the spring and seal from objects moving in the well bore.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENTS

Figure 1A:
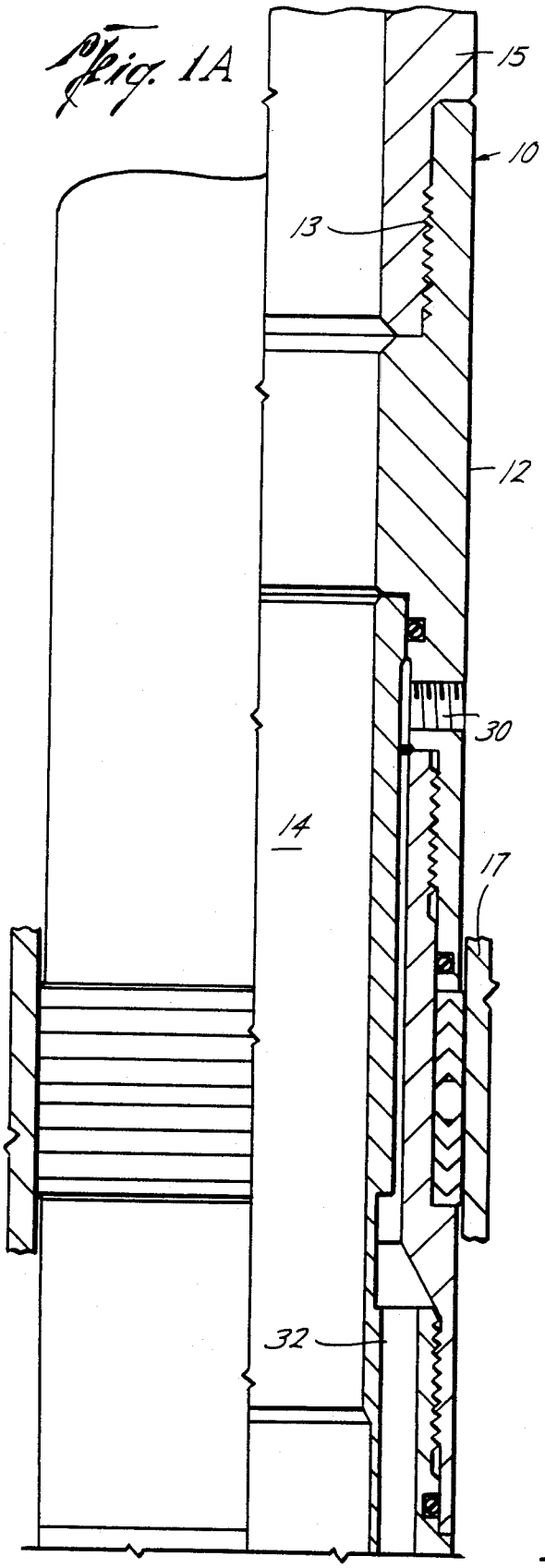
FIGS. 1A, 1B, 1C and 1D are continuations of each other and are elevational views, partly in cross section, of the safety valve of the present invention shown in the open position.
Figure 1B:
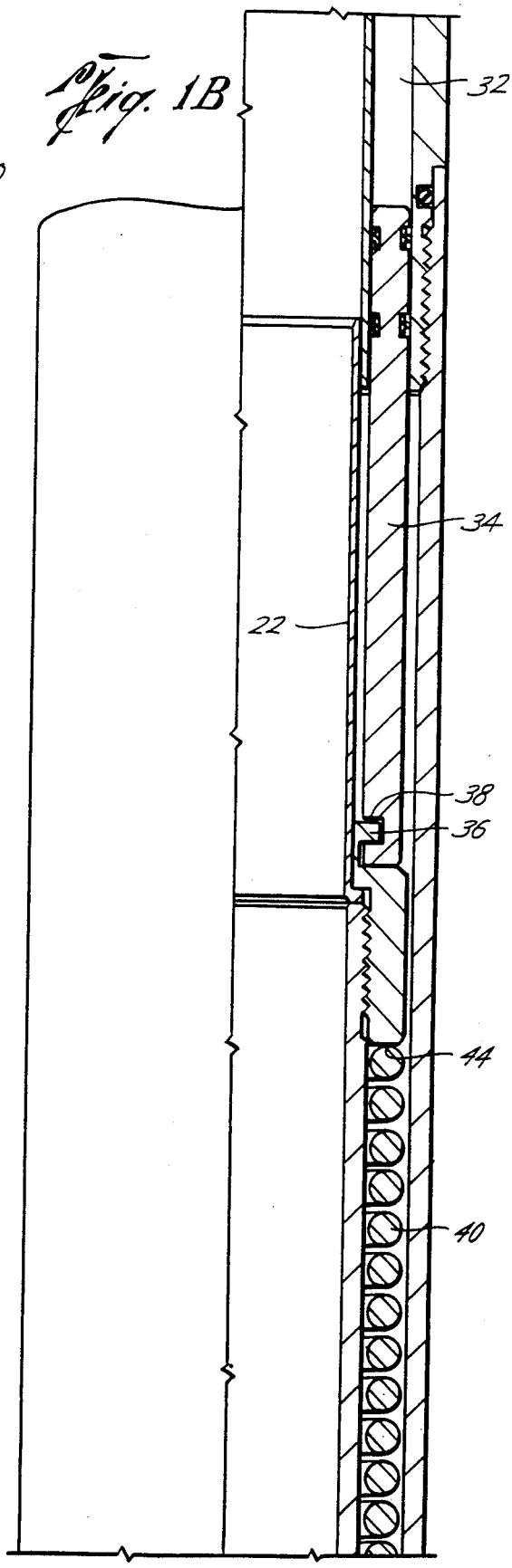
Figure 1C:
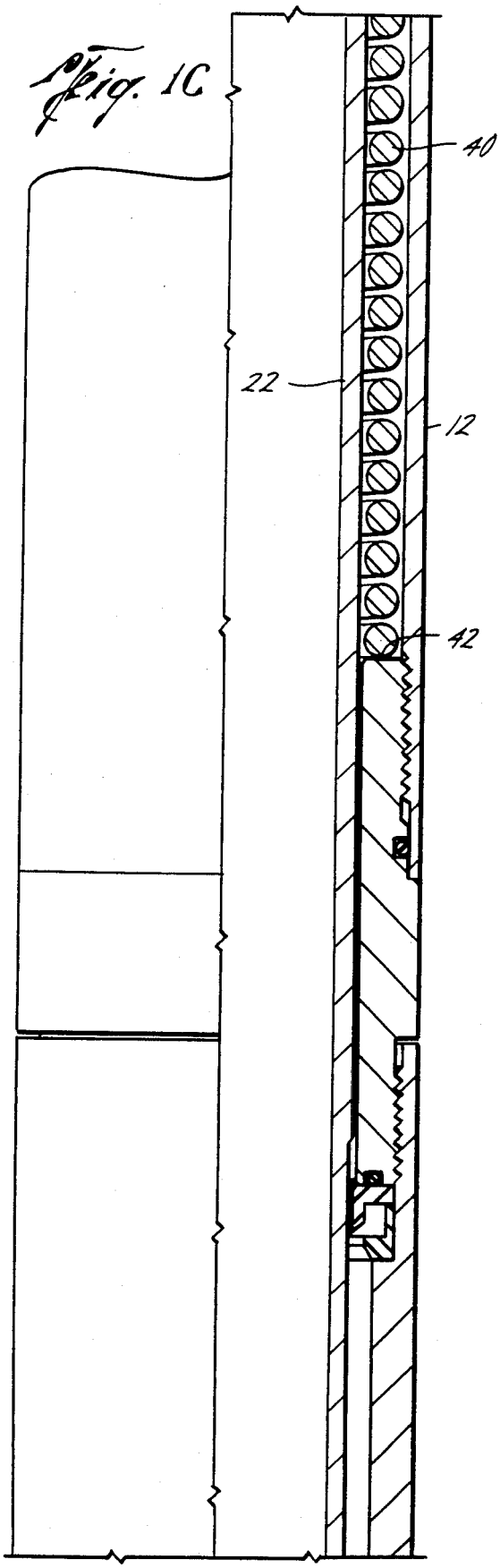

While the present improvement in a subsurface hydraulically actuated well safety valve will be shown, for purposes of illustration only, as a wire-line retrievable type of safety valve, it will be understood that the present invention may also be of a tubing retrievable type safety valve and electrically actuated safety valves.

Referring now to the drawings, a subsurface safety valve of the present invention is generally indicated by the reference numeral 10 and generally includes a housing 12 having threads 13 at the top thereof for connection to a suitable well tool 15 such as a well lock for connecting the valve 10 in a well tubing 17.

The housing 12 generally includes a bore 14 therethrough, in communication with the bore of well tubing 17, an annular valve seat 16 positioned about the bore 14, and a flapper valve closure member 18 connected to the body 12 by a pivot pin 20. Thus, when the flapper valve 18 is in the upper position and seated on the valve seat 16, the safety valve 10 is in the closed position blocking flow upwardly through the bore 14 and the well tubing 17. A tubular member or flow tube 22 is telescopically movable in the body 12 and through the valve seat 16.

Figure 1D:
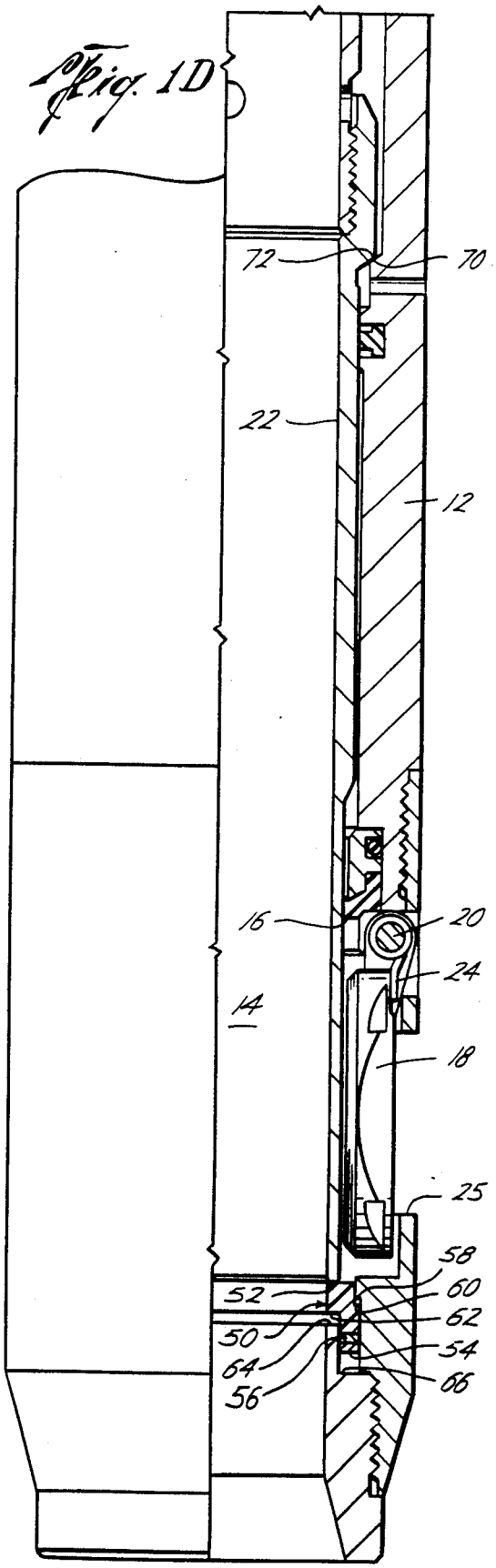

As best seen in FIG. 1D, when the tubular member 22 is moved to a downward position, the tube 22 pushes the flapper valve member 18 away from the valve seat 16. Thus, the valve 10 is held in the open position so long as the tubular member 22 is in the downward position. When the tubular member 22 is moved upwardly, the flapper 18 is allowed to move upwardly onto the seat 16 by the action of a spring 24 and also by the action of fluid flow moving upwardly through the well tubing 17 and entering a window 25 in the housing 12 to act against the back of the flapper 18 to move flapper 18 into the well bore 14 whereby the upward moving flow in the bore 14 will seat the flapper 18.

Various forces are provided to act on the tubular member 22 to control its movement. Thus, the safety valve 10 is controlled by the application or removal of a pressurized fluid, such as hydraulic fluid applied to a port 30 through a control line (not shown) extending to the well surface. The hydraulic fluid from port 30 is supplied to a hydraulic chamber 32 to one or more pistons 34 which are connected to the tubular member 22 such as by a tongue 36 and groove connection 38. Application of hydraulic pressure to the port 30 acts on the piston 34 to move the tubular member 22 downwardly through the valve seat 16 into the open position. Biasing means such as a spring 40 is provided connected between a shoulder 42 on the housing 12 and a shoulder 44 on the tubular member 22 for yieldably urging the tubular 22 in an upward direction to release the flapper valve member 18 for closing the valve 10. Therefore, in operation, hydraulic fluid is supplied to the port 30 to move the tubular member 22 downwardly forcing the flapper valve off of the seat 16 and into the full open position. If the fluid pressure at the port 30 is reduced sufficiently relative to the forces urging the tubular member 22 upwardly including the biasing spring 40, the tubular member 22 will be moved upwardly allowing the flapper valve member 18 to swing shut and close the seat 16.

The above description is generally disclosed in U.S. Pat. No. 4,161,219. However, fluid flow upwardly through the well tubing 17 flows about the valve element 18. Well fluids include abrasive components such as sand which will erode and damage the flapper valve element 18 as well as building up sand deposits around the flapper valve element 18, all of which decreases the service life of the valve 10. A space exists and fluid flows between the bottom of the tubular member and the housing in conventional safety valves as it is undesirable for the bottom end of the tubular member to engage the housing because of the danger that the tubular member might buckle or be damaged. In fact, a shoulder is provided between the tubular member and the housing to insure that the bottom end of the tubular member does not engage the housing.

In the present invention, a movable seal means generally indicated by the reference numeral 50 is provided telescopically movable in the housing 12 and positioned in the path of travel of the lower end 52 of the tubular member 22 for sealing against the lower end of the tubular member 22 when the valve is in the open position. In addition, suitable spring means such as a conventional wave spring 54 is provided between the housing 12 and the seal means 50 for urging a backup ring 56 and the seal means 50 upwardly towards the lower end 52 of the tubular member 22 for sealing and preventing the flow of high velocity well fluids through the window 25 and between the lower end 52 of the tubular member 22 and the housing 12. Fluid flow about the valve element will also occur in tubing retrievable type safety valves which do not include a window. The provision of the seal means 50 effectively limits the high velocity fluid flow across the flapper valve 18 thereby reducing erosion and sand buildup and increases the service life of the valve 10. The seal means 50 may be any suitable resilient and non-metallic seal means such as an elastomer or plastic.

Stop means are provided between the housing 12 and the seal means 50 for limiting the extent of travel of the seal means 50 in one or both of the upper and lower directions. Such stop means may include coacting shoulders 58 and 60 on the housing 12 and on the seal means 50, respectively, for limiting upward movement of the seal means 50. Similarly, shoulders 62 and 64 on the seal means 50 and on the housing 12, respectively, may be provided for limiting downward travel of the seal means 50.

In order to provide protection and support of the seal means 50 and spring 54, a recess 66 may be provided in the housing 12 spaced from the bore 14 for telescopically receiving a portion of the seal means 50 and for receiving the spring means 54 and backup ring 56.

When the tubular member 22 is moved downwardly and opens the flapper 18, a shoulder 70 on the tubular member 22 will engage a shoulder 72 on the housing 12 for limiting downward movement of the tubular member 22, but yet allow the lower end 52 of the tubular member 22 to engage the seal means 50. However, the spring 54 biases the seal 50 into a sealing engagement with the end 52 preventing fluid flow across the flapper valve 18. The spring 54 will also accommodate manufacturing tolerances to maintain a sealing relationship and will maintain a sealing relationship even in the event of wear between the seal 50 and end 52 of the tubular member 22.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A well subsurface safety valve comprising, a housing having a bore, a flapper valve closure member in the bore moving between open and closed positions, a tubular member telescopically movable in the housing for controlling the movement of the valve closure member, means for moving the tubular member downwardly for opening the valve closure member, biasing means contacting the tubular member for moving the tubular member upwardly for allowing the valve member to close, coacting engaging shoulders on the tubular member and said housing spaced from the lower end for limiting downward movement of the lower end of the tubular member, a movable resilient and non-metallic seal means telescopically movable in the housing and positioned in the path of travel of the lower end of the tubular member, stop means between the housing and the seal means limiting the extent of travel of the seal means in the upper and lower directions, and spring means between the housing and the movable seal means for urging the seal means toward the tubular member for sealing against the lower end of the tubular member when the valve is in the open position.

2. The apparatus of claim 1 wherein, said housing includes a recess spaced from said bore, said seal means includes a portion telescopically movable in the recess, and said spring means is positioned in the recess.

* * * * *